US010550808B2

(12) United States Patent
Millet

(10) Patent No.: US 10,550,808 B2
(45) Date of Patent: Feb. 4, 2020

(54) INJECTION SYSTEM OF AN INTERNAL COMBUSTION ENGINE AND AUTOMOTIVE VEHICLE INCLUDING SUCH AN INJECTION SYSTEM

(71) Applicant: VOLVO TRUCK CORPORATION, Göteborg (SE)

(72) Inventor: Guillaume Millet, Luzinay (FR)

(73) Assignee: VOLVO TRUCK CORPORATION, Göteborg (SE)

( * ) Notice: Subject to any disclaimer, the term of this patent is extended or adjusted under 35 U.S.C. 154(b) by 0 days.

(21) Appl. No.: 15/531,450

(22) PCT Filed: Dec. 19, 2014

(86) PCT No.: PCT/IB2014/003182

§ 371 (c)(1),
(2) Date: May 29, 2017

(87) PCT Pub. No.: WO2016/097799

PCT Pub. Date: Jun. 23, 2016

(65) Prior Publication Data

US 2017/0276112 A1 Sep. 28, 2017

(51) Int. Cl.
*F02M 47/02* (2006.01)
*F02M 55/00* (2006.01)
(Continued)

(52) U.S. Cl.
CPC ..... *F02M 47/02* (2013.01); *F02M 45/12* (2013.01); *F02M 47/022* (2013.01);
(Continued)

(58) Field of Classification Search
CPC ..... F02M 55/008; F02M 47/00; F02M 47/02; F02M 47/022; F02M 47/025; F02M 2547/00; F02M 2547/008
See application file for complete search history.

(56) References Cited

U.S. PATENT DOCUMENTS 4,069,800 A * 1/1978 Kanda ..... F02M 57/025 123/447
4,250,857 A * 2/1981 Taplin ..... F02M 45/00 123/448
(Continued)

FOREIGN PATENT DOCUMENTS

CN 103573503 A 2/2014
DE 19740997 A1 3/1996
(Continued)

OTHER PUBLICATIONS

International Search Report (dated Sep. 24, 2015) for correspoonding International App. PCT/IB2014/003182.
(Continued)

*Primary Examiner* — Kevin R Steckbauer
(74) *Attorney, Agent, or Firm* — Venable LLP; Jeffri A. Kaminski

(57) ABSTRACT

A fuel injection system of an internal combustion engine includes: an injector having a hydraulic control chamber controlling the delivery of fuel through the injector, an actively controlled first valve system controlling the pressure relief from the control chamber, movable between: a first position in which the first valve system closes the injector by deterring the pressure from being relieved from the control chamber through the first relief circuit, and a second position in which the first valve system opens the injector by allowing the pressure to be relieved from the control chamber through the first relief circuit. A second relief circuit allows the pressure to be relieved from the control chamber through the second relief circuit. The second relief circuit includes a second valve system passively controlled by the fuel pressure and movable between two positions deterring or allowing the pressure to be
(Continued)

relieved from the control chamber through the second relief circuit.

20 Claims, 9 Drawing Sheets

(51) Int. Cl.
*F02M 45/12* (2006.01)
*F02M 63/02* (2006.01)
*F02M 63/00* (2006.01)

(52) U.S. Cl.
CPC ..... *F02M 47/025* (2013.01); *F02M 47/027* (2013.01); *F02M 55/002* (2013.01); *F02M 55/008* (2013.01); *F02M 63/0017* (2013.01); *F02M 63/0035* (2013.01); *F02M 63/0225* (2013.01); *F02M 2200/28* (2013.01); *F02M 2547/008* (2013.01)

(56) References Cited

U.S. PATENT DOCUMENTS 4,940,037 A * 7/1990 Eckert ..... F02M 45/00 123/447
6,213,098 B1 * 4/2001 Kato ..... F02M 45/08 123/300
6,453,875 B1 * 9/2002 Mahr ..... F02M 47/027 123/446
6,752,325 B2 * 6/2004 Kropp ..... F02M 47/027 239/124
6,824,081 B2 * 11/2004 Peters ..... F02M 47/025 239/533.2
6,880,527 B2 * 4/2005 Magel ..... F02M 47/027 123/447
6,918,377 B2 * 7/2005 Boltz ..... F02B 1/12 123/299
7,007,671 B2 * 3/2006 Nakayama ..... F02D 41/3872 123/446
7,040,288 B2 * 5/2006 Nakayama ..... F02M 47/027 123/446
7,093,582 B2 * 8/2006 Magel ..... F02M 47/027 123/446
7,278,398 B2 * 10/2007 Magel ..... F02M 47/027 123/446
7,320,310 B2 * 1/2008 Eisenmenger ..... F02M 47/027 123/446
7,398,765 B2 * 7/2008 Yamamoto ..... F02M 57/025 123/467
8,100,110 B2 * 1/2012 Shinogle ..... F02M 45/06 123/294
8,100,345 B2 * 1/2012 Hotta ..... F02M 41/124 239/533.2
9,316,190 B2 * 4/2016 Fedrow ..... F02M 47/027
9,719,474 B2 * 8/2017 Sun ..... F02M 61/10
9,765,737 B2 * 9/2017 Kalenborn ..... F02M 47/02
10,113,523 B2 * 10/2018 Etlender ..... F02M 61/166
10,174,730 B2 * 1/2019 Harcombe ..... F02M 47/02
2002/0088435 A1 * 7/2002 Kropp ..... F02M 47/027 123/446
2003/0127539 A1 * 7/2003 Braun ..... F02M 47/027 239/533.2
2004/0000600 A1 * 1/2004 Peters ..... F02M 47/025 239/533.2
2004/0025843 A1 * 2/2004 Magel ..... F02M 47/027 123/446
2004/0134465 A1 * 7/2004 Boltz ..... F02B 1/12 123/446
2005/0116058 A1 * 6/2005 Magel ..... F02M 47/027 239/88
2005/0263622 A1 * 12/2005 Schlairet ..... F02M 57/023 239/533.2
2006/0005815 A1 * 1/2006 Magel ..... F02M 47/027 123/446
2006/0196474 A1 * 9/2006 Magel ..... F02M 47/027 123/446
2006/0289681 A1 * 12/2006 Boecking ..... F02M 45/086 239/533.3
2008/0041977 A1 * 2/2008 Hotta ..... F02M 41/124 239/533.12
2011/0048379 A1 * 3/2011 Sommars ..... F02M 47/027 123/456
2012/0174893 A1 * 7/2012 Harcombe ..... F02M 47/02 123/446
2014/0251276 A1 * 9/2014 Schurz ..... F02M 51/0603 123/456
2015/0337786 A1 * 11/2015 Sun ..... F02M 61/10 239/5
2016/0146172 A1 * 5/2016 Etlender ..... F02M 61/166 123/472
2017/0276112 A1 * 9/2017 Millet ..... F02M 45/12

FOREIGN PATENT DOCUMENTS

DE 19740997 A1 * 3/1998 ..... F02M 45/12
DE 10131619 A1 * 1/2003 ..... F02M 45/00
DE 102008044043 A1 5/2010
EP 2295784 A1 3/2011
RU 2422667 C1 6/2011

OTHER PUBLICATIONS

Chinese Official Action (dated Oct. 31, 2018) for corresponding Chinese App. 201430084190.8.

* cited by examiner

INJECTION SYSTEM OF AN INTERNAL COMBUSTION ENGINE AND AUTOMOTIVE VEHICLE INCLUDING SUCH AN INJECTION SYSTEM

BACKGROUND AND SUMMARY

The present invention concerns an injection system of an internal combustion engine and an automotive vehicle including such an injection system.

Common rail fuel injection systems are used in most of diesel engines, from passenger cars to large heavy duty engines. The injection rate of these injection systems, i.e. the instantaneous injected flow curve, has a fixed profile as the available pressure in the injector during an injection is considered almost constant. However, a slow and progressive delivery of fuel at the very start of the main injection can be beneficial to decrease gases emissions, for example NOx emissions, in the first phase of the combustion.

Besides that, if the opening phase is too slow, it can lead to too long injection durations, which implies loss of combustion efficiency or problems due to too late end of injection, or instable injector opening and poor control of the total fuel injected quantity. Thus, it can be advantageous to reach full needle opening and spray formation on most of engine operating points.

DE-A-197 40 997 discloses an injection system having a control valve controlled by a solenoid. When the solenoid is not supplied with electric power, the control valve is urged downwards by a spring in order for injector to rise in an open position, against the return force of a second spring. When electrical power is supplied to the solenoid, the control valve is lifted in an open position at a low lift speed. During the lift of the needle, an additional fuel path is opened, which leads to an acceleration of the lift of the needle, so the speed of the fuel flow gets higher. Opening of the additional fuel path is controlled by the position of the needle. In this way, during the injector opening, the infection rate has two slopes. However, such an arrangement is not favorable for the needle movement control, which is expected to be free from side loads in order to avoid problems of poor spray symmetry, poor needle movement consistency and accelerated wear.

It is desirable to provide an injection system enabling to have two slopes of the injection rate during the injector opening, offering the option to tune the profile in terms of slope and duration in the opening phase, thanks to the selection of the right hardware features.

It is also desirable to keep an independent control of the injection closure velocity, as this feature is known to influence pollutant formation at the end of the combustion process.

It is also desirable to provide an injection system having a limited cost, a reduced size and complexity, in particular with the intention to keep an injector design with a single electronically controlled valve.

According to a first aspect of the invention, a fuel injection system of an internal combustion engine is provided, comprising:

- an injector having a hydraulic control chamber controlling the delivery of fuel through the injector,
- an actively controlled first valve system controlling the pressure relief from the control chamber, the first valve system being movable between:

- a first position in which the first valve system closes the injector by deterring the pressure from being relieved from the control chamber through the first relief circuit, and
- a second position in which the first valve system opens the injector by allowing the pressure to be relieved from the control chamber through the first relief circuit.

The fuel injection system comprises a second relief circuit allowing the pressure to be relieved from the control chamber. The second relief circuit comprises a second valve system having a control port passively controlled by the fuel pressure and movable between:

- a first position in which the second valve system deters the pressure from being relieved from the control chamber through the second relief circuit and
- a second position in which the second valve system allows the pressure to be relieved from the control chamber through the second relief circuit.

By the provision of an injection system which comprises a passive valve movable depending on the pressure in the chamber, the injection system is safe, has a limited cost, and a reduced size and complexity.

The system may comprise also one or several of the following features:

- the first valve system may include a first directional control valve having a first port designed to be connected to a high pressure fuel source;
- the first relief circuit may include a first relief line having a first flow resistance for controlling the flow rate of the fuel relieved from the control chamber.
- during a first injection phase in which the pressure is relieved from the control chamber through the first relief circuit and in which the second valve system deters the pressure from being relieved from the control chamber through the second relief circuit, a first speed of increase of the injection rate may be determined by the first flow resistance.
- the second relief circuit may include a second relief line having a second flow resistance for controlling the flow rate of the fuel relieved from the control chamber (12);
- in a second injection phase in which pressure is relieved from the control chamber through the second relief circuit, a second speed of increase of the injection rate is determined.
- the second speed of increase may be higher than the first speed of increase.
- the control port of the second valve system may be connected to:
- an opening control line having a flow resistance, for adjusting the timing between the first injection phase and the second injection phase,
- a closing control line having a smaller flow resistance than the opening control line and a equipped with a check valve preventing flow of fuel from the control port of the second valve system.

This allows asymmetrical time responses between opening and closing of the second valve system.

- the first valve system may include a first directional control valve electromagnetically controlled by an electronic control unit.
- the first valve system may include a mechanical return device for returning the first valve system in the first position.
- the second valve system may include mechanical return means for returning the second valve system in the first position.

the injection system may include a third flow restrictor for adjusting the closing speed of the injector.

the injection system may include:

a pressure feed line for feeding the control chamber with pressurized fuel, said pressure feed line being equipped with a first check valve preventing flow of fuel from the control chamber, and a first relief line, in parallel to the pressure feed line and having a first flow resistance, for relieving fuel from the control chamber though the first valve system.

the third flow restrictor for adjusting the closing speed of the injector may be located in the pressure feed line.

the system may include a needle and the pressure in the control chamber may control the position of the needle and the delivery of fuel through nozzles.

when the pressure in the control chamber is above a pressure threshold, the needle closes the nozzles and in that when the pressure in the control chamber is below the pressure threshold, the needle opens the nozzles.

the injector system may include a mechanical return device applying a closing force to the needle for maintaining the needle in the closed position.

the first valve system and the second valve system may be integrated in a common body part and the needle is disposed in a pressure chamber having nozzles for fuel delivery, the pressure chamber being located inside the body part.

the needle may be movable in a pressure chamber by means of the difference in pressure between the control chamber and the pressure chamber.

in the first position of the first valve system the pressure may be delivered to the control chamber through the first valve system.

According to a second aspect of the invention, an automotive vehicle including such a fuel injection system is provided.

BRIEF DESCRIPTION OF THE DRAWINGS

With reference to the appended drawings, below follows a more detailed description of six embodiments of the invention cited as examples.

In the drawings.

DETAILED DESCRIPTION

Figure 14:
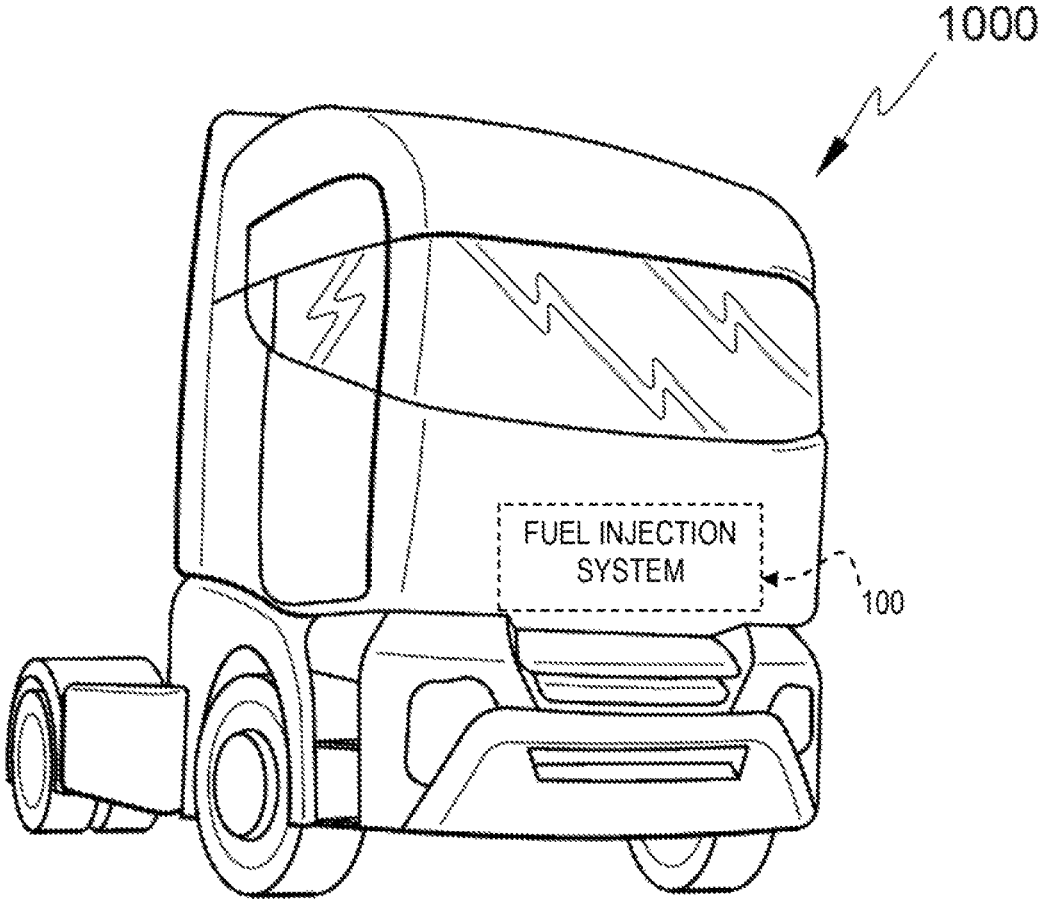
FIG. 14 is a perspective view of a truck including an injection system according to the invention.

FIG. 14 shows an automotive vehicle 1000. In the example of FIG. 14, the automotive vehicle is a truck. The invention also applies to other types of automobile vehicles, such as buses, and to offroad machines, such as construction machines or industrial machines, for example power supply stationary engines. The invention also applies to marine machines.

The vehicle 1000 includes an engine having a fuel injection system 100, shown on FIGS. 1 to 6.

The fuel injection system 100 comprises an injector or injector nozzle 10 having a hydraulic control chamber 12 controlling the delivery of fuel through the injector 10. The injector 10 is equipped with a needle 11. The pressure in the control chamber 12 controls the position and the movement of the needle 11, and as a result the delivery of fuel through nozzles 34 of the injector 10. In an embodiment, the position (or lift) of the needle controls the fuel injection rate, i.e. the flow rate of fuel delivered through the injector. The injection rate may be proportional to the needle lift, although not necessarily linearly proportional. The needle position, and as such the fuel injection rate, is correlated to the volume of fuel in the control chamber.

The injection system 100 includes a first valve system 20 comprising a first directional control valve 22 having three ports 22.1, 22.2 and 22.3. The first directional control valve 22 is movable between two positions. The position of the first directional control valve 22 is actively controlled by an electronic control unit, not shown. According to the invention, an active control supplies electrical power in order to switch the position of the first directional control valve 22. For example, the position of the first directional control valve 22 is controlled electromagnetically by a spool 24 controlled by the electronic control unit.

Figure 1:
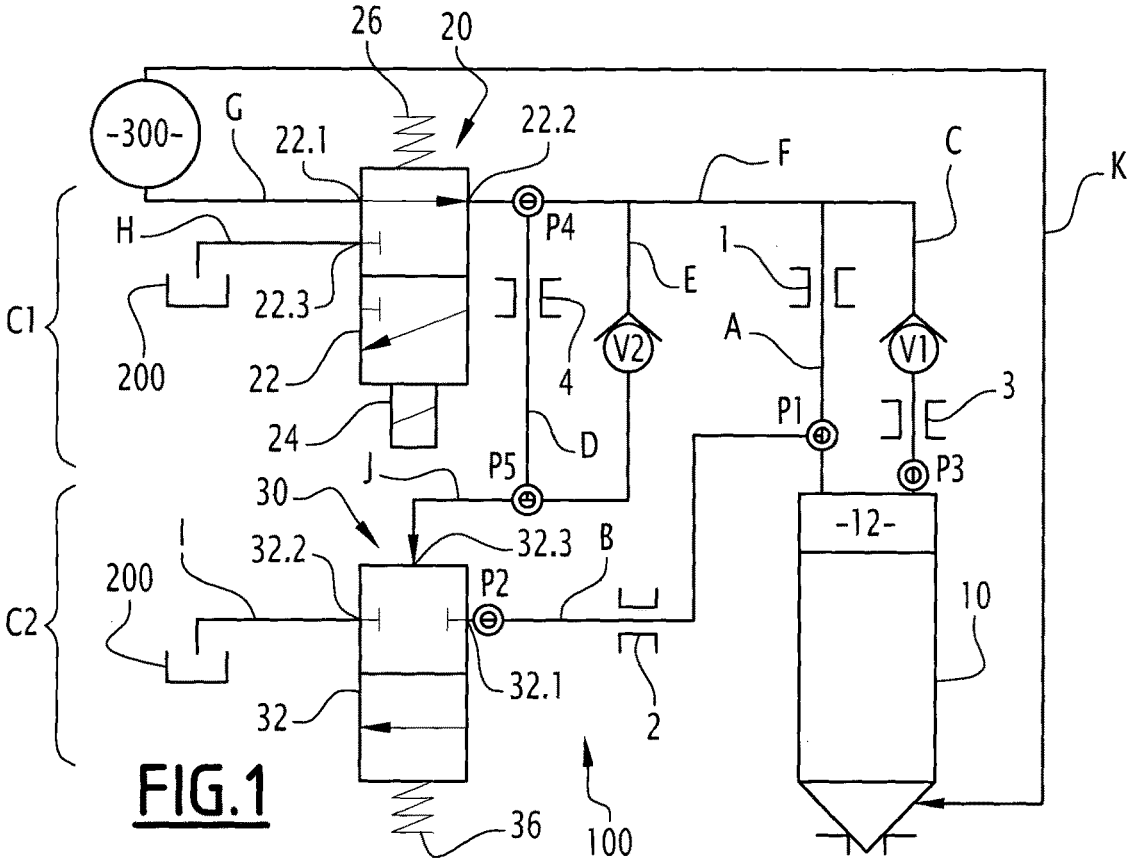
FIGS. 1 to 6 are schematic representations of the injection system, in successive operating configurations.
Figure 5:
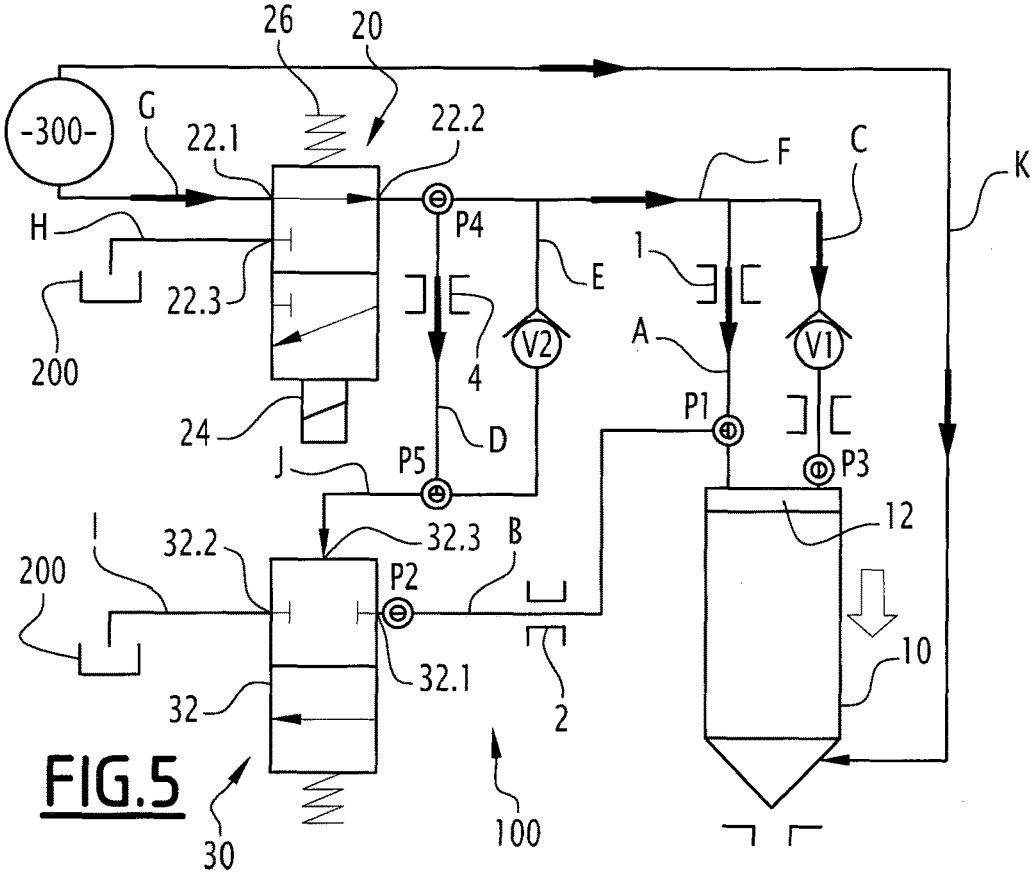
Figure 6:
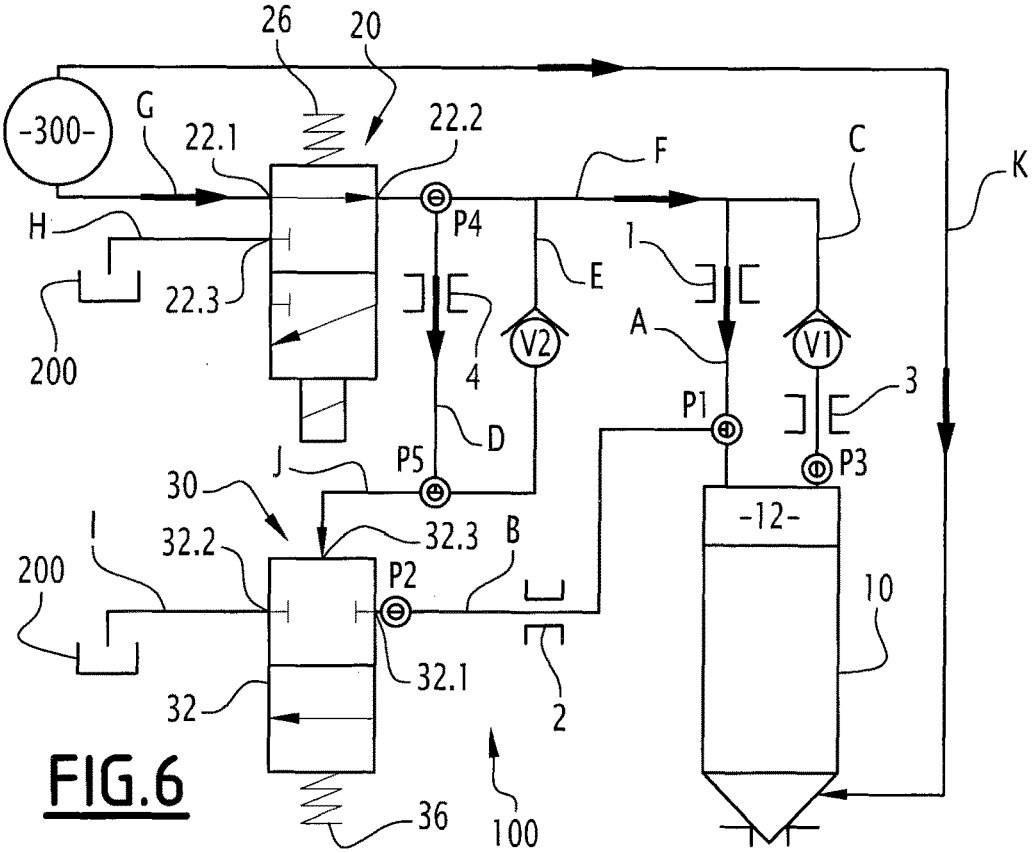

In the first position or rest position of the main valve system 20, shown on FIGS. 1, 5 and 6, the spool 24 is not actuated by the electronic control unit. Mechanical return means such as elastic means, for example a spring 26, keep the first directional control valve 22 in the first position. In the first position, the first port 22.1 is connected to the second port 22.2 and the third port 22.3 is closed.

Figure 2:
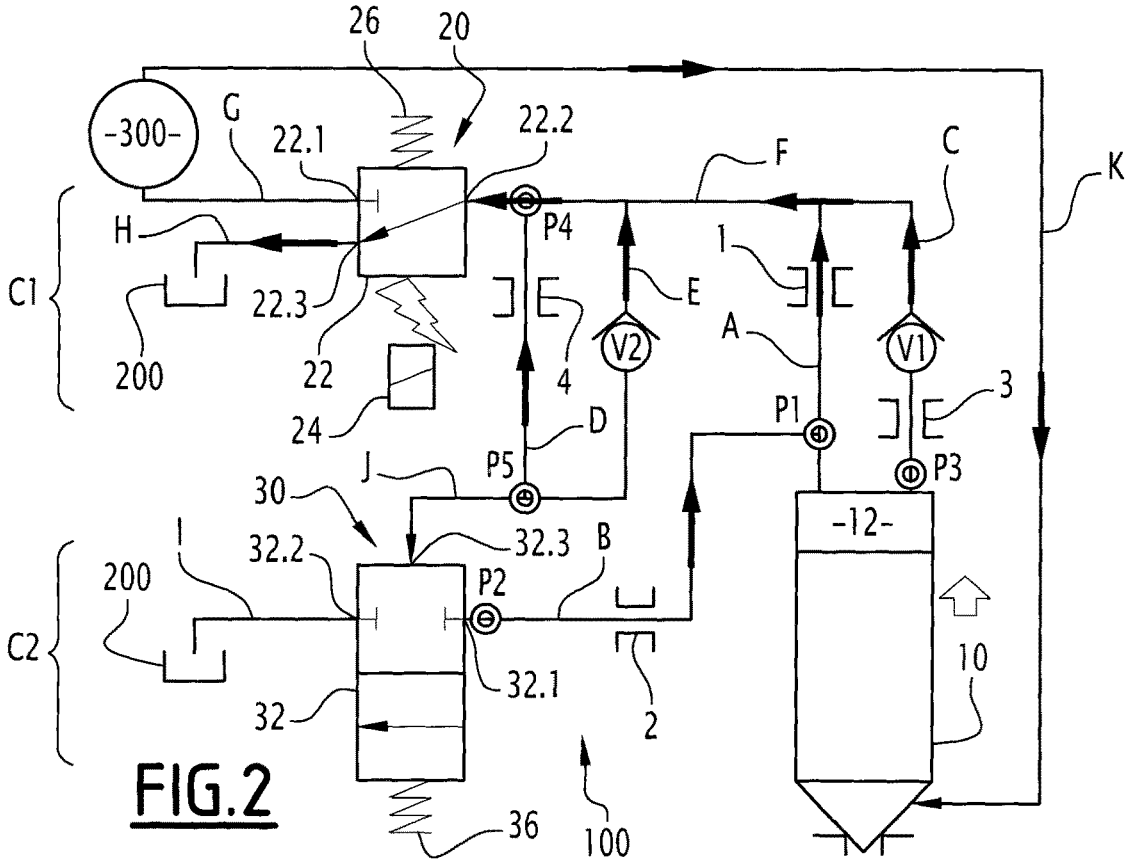
Figure 3:
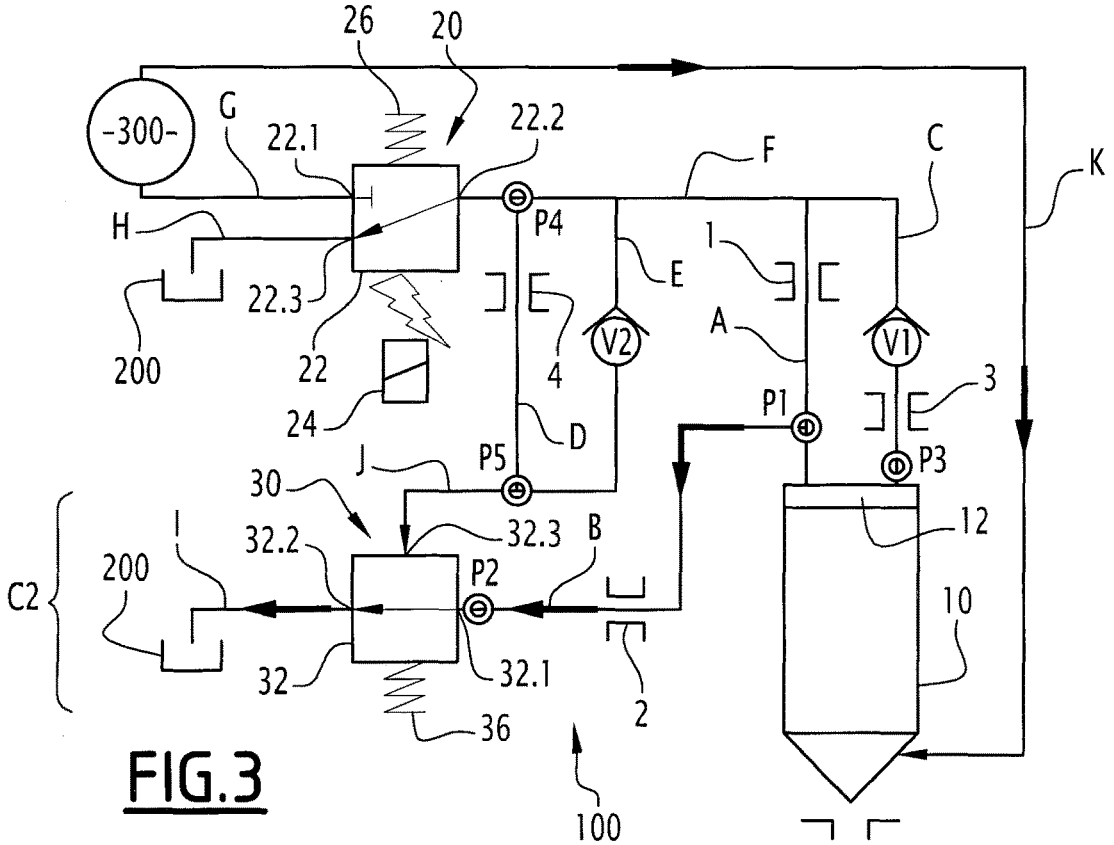
Figure 4:
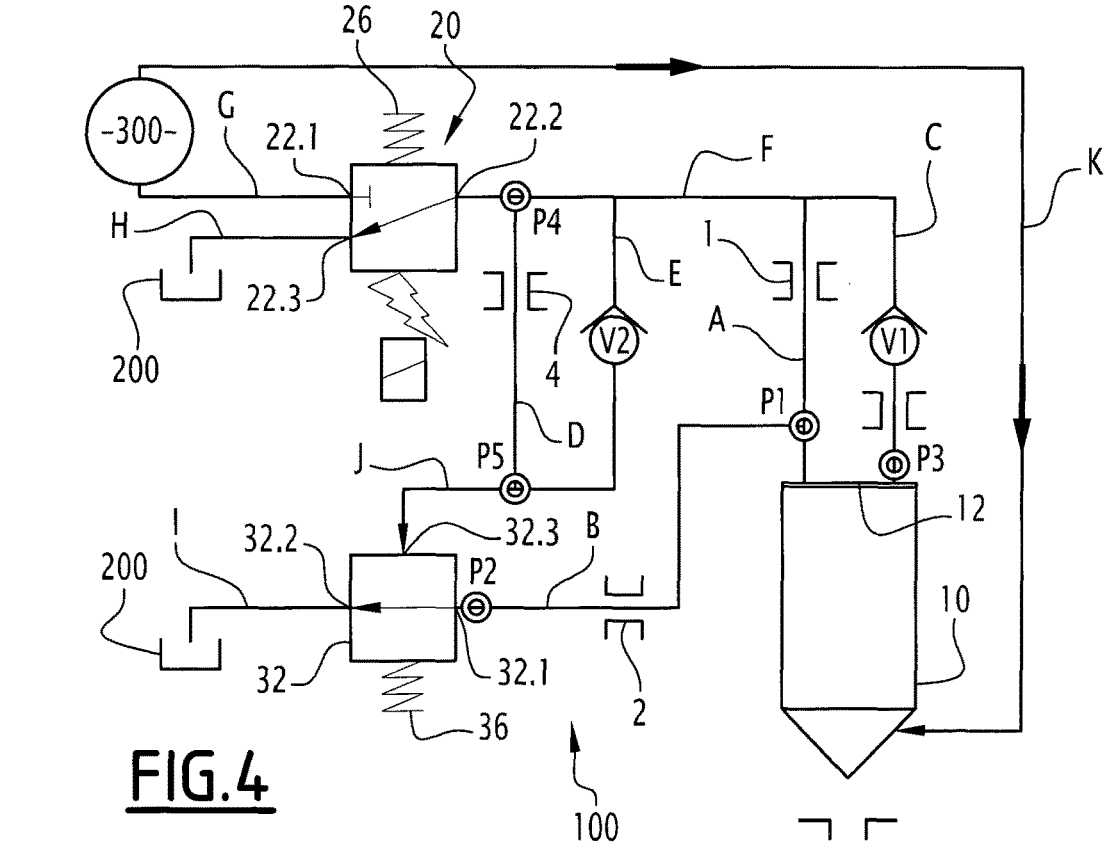

In a second position or active position of the first directional control valve 22, shown on FIGS. 2, 3 and 4, the spool 24 is actuated by the electronic control unit, and pushes the first directional control valve 22 against the return force exerted by the spring 26. Until the spool 24 is actuated, the spool 24 keeps the first directional control valve 22 in the second position. In the second position, the first port 22.1 is closed and the second port 22.3 is connected to the third port 22.2.

On FIGS. 2, 3 and 4, for the sake of simplicity, a portion of control valve 22 is omitted, that is the one which is aligned with ports 22.1 to 22.3 in the configuration of FIG. 1.

The injection system 100 includes fuel lines A to K.

The injection system 100 includes a first connecting point P1, a second connecting point P2, a third connecting point P3, a fourth connecting point P4, a fifth connecting point P5, a first checkvalve V1, a second checkvalve V2. The injection system 100 further includes flow restrictors, for example calibrated orifices having predetermined dimensions. In the example of the figures, the injection system 100 may include a first calibrated orifice 1, a second calibrated orifice 2, a third calibrated orifice 3 and a fourth calibrated orifice 4.

An upstream feed line G connects the first port 22.1 to a high pressure source 300 supplying fuel having a high pressure. For example, the high pressure source 300 is the common rail of an internal combustion engine. The internal combustion engine may be a compression ignition engine such as a diesel engine, or a spark-ignited engine such as a gasoline engine. The injection system 100 can be used in direct injection systems where fuel is injected in a cylinder of the internal combustion engine. A first tank line H connects the third port 22.3 to a fuel tank 200 of the engine. The second port 22.2 is connected to a joint line F, which is connected to successive fuel lines D, E, A and C, in a direction from the second port 22.2 and along the joint line F.

A first end of a first relief line A is connected to the joint line F. The opposite end of the first relief line A is connected to the control chamber 12. The first connecting point P1 connects the second relief line B to the first relief line A, between the first orifice 1, and the control chamber 12. The first orifice 1 is situated along the first relief line A, between the first connecting point P1 and the joint line F.

A first end of the pressure feed line C connects an end of the joint line F to the control chamber 12, at the third connecting point P3. The first checkvalve V1 and the third calibrated orifice 3 are situated along the pressure feed line C, between the third connecting point P3 and the end of the joint line F. The third orifice 3 is situated between the first checkvalve V1 and the third connecting point P3. Fuel can pass the first checkvalve V1 in a direction from the joint line F to the third connecting point P3. In the opposite direction, the first checkvalve V1 prevents fuel from flowing from joint line F to point P3.

The main valve system 20 controls the relief of the pressure of the fuel flowing from the control chamber 12 towards a main relief circuit C1 comprising the orifice 1.

In the first position of the first valve system 20, the first valve system 20 closes the injector 10 by deterring the pressure from being relieved from the control chamber 12 through the first relief circuit C1. In the second position, the first valve system 20 opens the injector 10 by allowing the pressure to be relieved from the control chamber 12 through the first relief circuit C1.

In addition to the main relief circuit C1, an auxiliary relief circuit C2 different from the first relief circuit C1 allows the pressure to be relieved even quicker from the control chamber 12. The relief circuit C2 comprises a second valve system 30 including a second directional control valve 32 having two ports 32.1 and 32.2 and being movable between two positions. The second port 32.2 is connected to the fuel tank 200 via a second tank line I. The two fuel tanks 200 are represented separately but in practice the line H and I are connected to a single fuel tank. However, in a variant, the tank lines H and I may be connected to two different fuel tanks.

The high pressure source 300 and the fuel tank(s) 200 are connected to the injection system 100, respectively via fuel lines G, H and I, the injection system 100 including the valve systems 20 and 30. Together, the high pressure source 300, the fuel tank(s) 200 and the injection system 100 form an "injection assembly".

The first port 32.1 is connected to a second connecting point P2 of the line B. A second orifice 2 is situated between the connecting points P1 and P2, along the second relief line B.

The second directional control valve 32 is passively controlled. According to the invention, a passive control does not use electrical power in order to switch the position of the second directional control valve 32. The position of the second directional control valve 32 has a control port 32.3 hydraulically controlled by the passive fuel line J, depending on the pressure en the passive control line J.

The second check valve V2 is located between the control port 32.3 of the second valve system 30 and the second port 22.2 of the first valve system 20.

The second valve system 30 is piloted depending on a pressure in the control chamber 31, independently of the position the needle 11.

When the pressure Pj in the passive control line J is above a first pressure threshold Pt1, the pressure Pj pushes the second directional control valve 32 against a return force of mechanical return means, for example elastic return means, such as a spring 36. In this first or active position shown on FIGS. 1 and 2, the first port 32.1 and the second port 32.2 are closed, so the fuel cannot flow from the second relief line B to the fuel tank 200 via the second tank line I.

When the pressure Pj in the tenth line J is under the first pressure threshold Pt1, the spring 36 pushes the second directional control 32 valve in a second or active position, shown on FIGS. 3 and 4. In the second position, the first port 32.1 and the second port 32.2 are connected to each other so the fuel can flow from the second relief line B to the fuel tank 200 via the second tank line I.

In this example, the control port 32.3 of the second valve is here connected (in this case vie the passive control line J) to separate lines having different flow resistances.

An opening control line D is connected to the joint line F at the fourth connecting point P4. The opening control line D is connected to the passive control line J at the fifth connecting point P5, but could be directly connected to the control port 32.3. A calibrated fourth orifice 4 may be situated between the connecting points P4 and P5, on the opening control line D, for limiting the flow rate through this opening line.

The passive control line J is represented on the FIGS. 1 to 6 as a fuel line, but it can comprise a fuel chamber having a variable pressure.

A closing control line E connects the joint line F to the fifth connecting point P5 and includes the second check valve V2. Fuel can flow through the second check valve V2 in a direction from the joint line F to the fifth connecting point P5. In the opposite direction, the second check valve V2 prevents fuel from flowing from connecting point P5 to joint line F, i.e. prevents flow of fuel from the control port 32.3 of the second valve back to the joint line though the closing control line E. The flow resistance of the closing control line E is less than that of the opening control line D.

Switching of the second control valve is controlled at different speed thanks to the fact that the flow resistance through the opening and closing control lines D and E are different. When high pressure is present in line F, fuel will flow predominantly through closing control line E to cause closing of the second valve 30, thus causing quick closing of the second valve, i.e. quick shifting to its first position. To the contrary, in case of low pressure in line F, the fuel escaping from control port 32.3 will only be able to flow through the opening control line D at a limited flow rate, thus delaying the opining of the second valve 30, i.e. delaying shifting to its first position.

Opening and closing control lines are here represented as distinct parallel lines.

However, they could be embodied as a single control line equipped with a unidirectional flow limiter limiting a flow of fuel to a lower value is the way from the control port than in the way to the control port of the second valve system, for delaying the opening of the second control valve.

On FIGS. 3 and 4, for the sake of simplicity, a position of control valve 32 is omitted, that is the one which is aligned with parts 32.1 and 32.2 in the configuration of FIG. 1.

Figure 8:
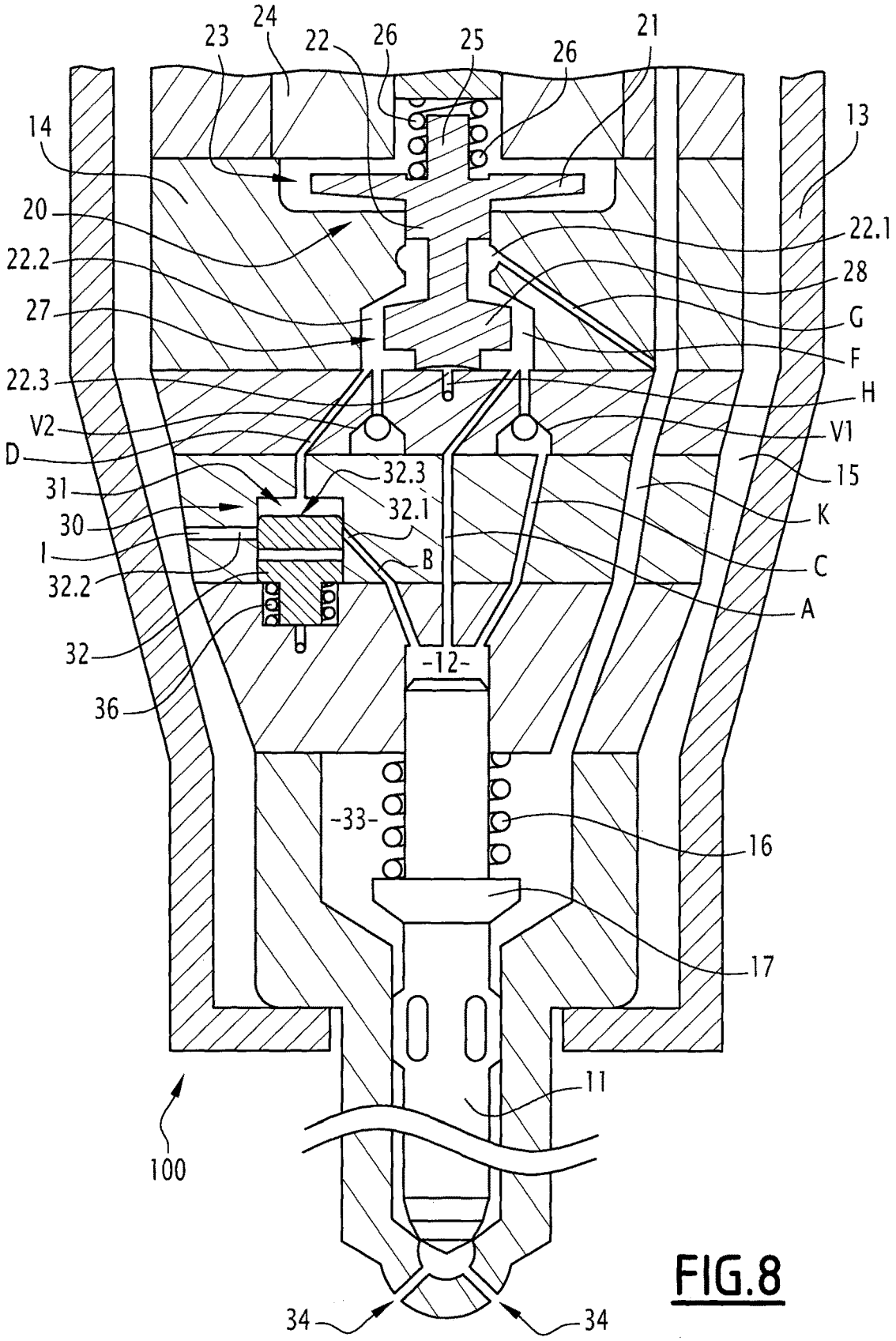
FIG. 8 is an example of a physical implementation of the injection system of FIGS. 2 to 7.

In a known manner, the injector 10 includes a needle 11, movable by means of the difference in pressure between the control chamber 12 and a high pressure line K connecting the high pressure source 300 to the injector 10, more precisely to a pressure chamber 33 around the needle 11, shown on FIG. 8. An acting surface of the top needle 11 area in the control chamber 12 is larger than an acting surface of the bottom needle 11 area, in contact with the fuel in the high pressure line K. When the pressure in the control chamber 12 is above a second pressure threshold Pt2, the needle 11 is moved downwards by the pressure on the top acting surface, and closes the nozzles 34. When the pressure in the control chamber 12 is below the second pressure threshold Pt2, the pressure on the bottom acting surface moves the needle 11 upwards and opens the nozzles 34 of the injector 10. In addition, a mechanical return device, such as a spring 26, shown on FIG. 8 only, applies a closing force to the needle 11, so the injector 10 is maintained in a closed position even when the high pressure source 300 does not deliver internal pressure and even under bottom force from the cylinder 10 compression.

Figure 7:
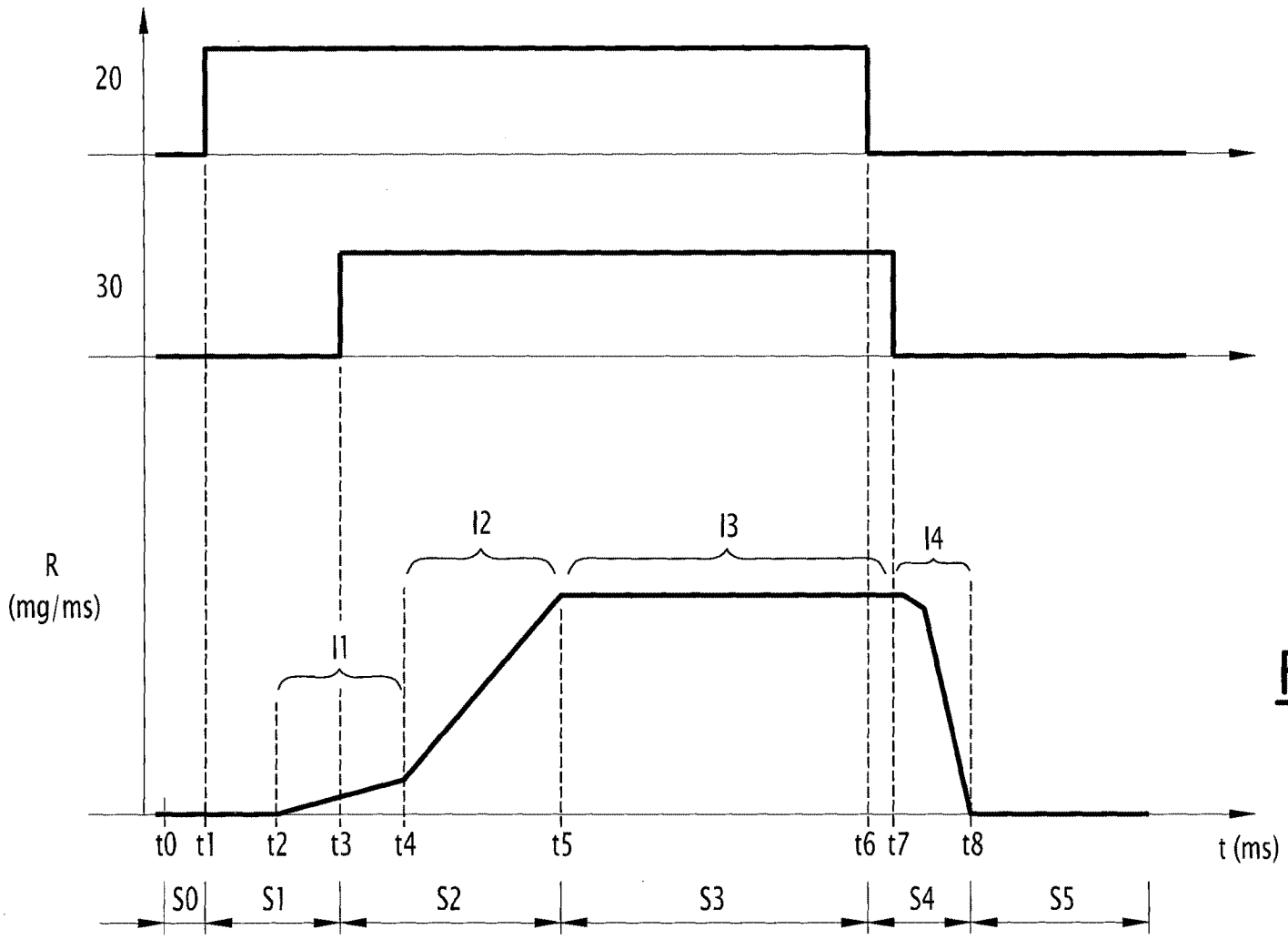
FIG. 7 is a graph showing the injection rate of an injector of the injection system, depending on the state of valves of the injection system.

FIG. 1 shows the injection system 100 during an initial stage SO in which the injector 10 is not actuated. The initial stage lies between an initial time $t_0$ and a first time shown on FIG. 7. During the initial stage SO, the injection rate is equal to zero. The injection rate is the ratio between the fuel quantity delivered by the injector, expressed in mg, divided by the injection duration, expressed in Ms.

During the initial stage SO, the spool 24 is not actuated by the electronic control unit, and the spring 26 keeps the first directional control valve 22 in the first position. The first directional control valve 22 connects the upstream feed line G to the joint line F, via the first port 22.1 and the second port 22.2. In other words, the high pressure source 300 is connected to the first relief circuit C1 via the upstream feed line G, through the first valve system 20. The fuel tank 200 does not communicate with the relief circuits C1 and C2 so the pressure in the relief circuits C1 and C2 is the highest. The pressure in the control chamber 12 is above the second pressure threshold Pt2, so the needle 11 closes the nozzles 34 of the injector 10.

In the example of FIGS. 1 to 6, the fuel is fed and relieved from control chamber 12 through a single circuit, namely the first relief circuit C1. In a variant, the first relief circuit C1 includes a feeding circuit and a relief circuit which may have common parts and separate parts, or which may be entirely separate.

During a first stage S1 shown on FIG. 2, the first directional control valve 22 is moved in the second position, by means of the electronic control unit which actuates the spool 24 at the first time moment. Thus, the first directional control valve 22 prevents the high pressure source 300 to be connected to the first relief circuit C1, and connects the joint line F to the fuel tank 200, via the first tank line H.

Consequently, the pressure at the connecting point P1 drops, because fuel flows from the control chamber 12 to the fuel tank 200, via the first relief line A. The flow passes through the first orifice 1, so the pressure in the control chamber 12 drops below the second pressure threshold Pt2. The pressure at the fifth connecting point P5 also starts to drop. The needle 11 of the injector 10 slowly starts to move upward, which causes the opening of the fuel access to the nozzle of the injector 10.

A first injection phase 11 starts at a second time moment $t_2$ of the first stage S1, slightly after the first time moment ti due to a delay caused by the electrical mechanical and hydraulic elements. During the first injection phase 11, the injection rate slowly increases, along a first slope determined by the calibration of the first orifice 1. The first slope corresponds to the speed of increase of the injection rate.

The time moment $t_3$ corresponds to the beginning of a second stage S2, in which the pressure at the fifth connecting point P5 drops below the first pressure threshold Pt1, hence triggering the movement of the second directional control valve 32 which switches to its second position.

Between the third time moment $t_3$ and a fourth time moment $t_4$ corresponding to the end of the first injection phase M, given the inertia of the system, the speed of increase of the injection rate remains constant.

During the second stage S2, shown on FIG. 3 4, the second valve system 30 connects the fuel line B and the fuel line I. Consequently, a second flow is created from the control chamber 12 to the auxiliary relief circuit C2, via the second line B and across the second orifice 2. During the second stage S2, the fuel evacuates from the control chamber 12 by both orifices 1 and 2. The second flow accelerates the needle 1 opening speed from a fourth time moment $t_4$ corresponding to the beginning of a second injection phase 12, hence increasing the speed of increase of the injection rate. This second speed of increase is higher than the first speed of increase, providing a dual spill flow principle. In other words, the second slope is steeper than the first slope.

The fifth time moment $t_5$ corresponds to the end of the second injection phase 12 and to the beginning of a third stage S3, shown on FIG. 4, and of a third injection phase 13, in which the pressure in the lines A, B, C, D, E, F and J are fully released in the low pressure lines H and I through the valve systems 20 and 30. The fuel in the control chamber 12 is spilled out, and the needle 11 of the injector 10 has reached its upper lift stop. The injector 10 spills fuel at full needle 11 lift, at a maximum injection rate.

The sixth time moment $t_6$ corresponds to the beginning of a fourth stage S4, shown on FIG. 5, when the electronic control unit stops actuating the spool 24 of the first valve system 20. The spring 26 moves the first directional control valve 22 in the first position, so that the high pressure source 300 is connected to sixth line F via the upstream feed line G and via the first valve system 20. Consequently, the pressure at the fourth connecting point P4 increases quickly. The pressure in the joint line F opens of the check valves V1 and V2. Consequently, a flow goes at high speed from the joint line F towards the connecting points P3 and P5.

At a seventh time moment $t_7$, the second valve system 30 is quickly moved to its first position, thanks to the pressure in the tenth line J which rises above the first threshold level Pt1. The third injection phase 13 ends at the seventh time moment $t_7$. As the pressure in the control chamber 12 increases and reaches the second threshold level Pt2, the needle 11 of the injector 10 starts to move downwards. The injection rate decreases during a fourth injection phase 14, with a third slope or third speed of decrease.

The time moment $t_8$ corresponds to the beginning of a fifth stage S5, shown on FIG. 6, where the pressure from the high pressure source 300 fully fills in the lines A, B, C, D, E, F and J and the control chamber 12, The needle of the injector 10 reaches its bottom seat and the injection is stopped.

The tilting of the slope, i.e. the speed of increase, of the injection rate during the first injection phase 11 depends mainly on the calibration of the first orifice 1. The tilting of the slope of the injection rate during the second injection phase 12 is steeper than the tilting of the first slope and depends mainly on the calibration of the second orifice 2. The design of the fuel injection system 100 can be adjusted in order to set the tilting of the first and second slopes.

The duration of the transition between the first stage S1 and the second stage S2 depends on the calibration of the fourth orifice 4, on the characteristics of the spring 36 of the second valve system 30 and on the surface area of the second valve system 30 in contact with the fuel of the passive control line J, which has a pressure equal to the pressure at the connecting point P5.

The closing speed of the needle 11 of the injector 10 is mainly adjusted by the calibration of the third orifice 3. When the check valves V1 end V2 are open, the fuel flows in lines C and E at high speed, as the restriction of the flow caused by the check valves V1 and V2 is lower compared to the third orifice 3. The balance between active surface of the control chamber 12 and line K to needle 11 also adjust, to a lesser extent, the closing speed of the needle 11

In order to ensure an optimum performance, the duration of the closing of the second valve system 30, between its second position and its first position, is set very short relative to the duration of the refilling process of the control chamber 12 and to the duration of the needle 11 closing phase. This allows limiting the high pressure fuel leakages from the control chamber 12 to the ninth line I. This adjustment can be done with a good balance of the characteristics of the second check valve V2, of the active surface of the second valve system 30, which determines the active pressure at the connecting point P5, and of the spring 36 of the second valve system 30, with respect to the first check valve V1 and to the third orifice 3.

Thanks to the invention, the injector 10 has two different injection rate speeds of increase during the needle 11 opening process, which allows limiting the gases emissions.

Besides, it is possible to set these two speeds of increase independently, by adjusting the dimensions of the calibrated orifices 1 and 2. Additionally, it is possible to adjust the duration of the first injection phase 11 and of the second injection phase 12, with respect to the duration of the complete needle 11 opening phase.

In order to optimize the velocity of the closing of the injector 10 independently from the two speeds of increase of the injection phases 11 and 12, it is possible to keep an independent control of the speeds of decrease of the injection rate during the fourth injection phase 14, by calibrating the third orifice 3.

These advantageous features are achieved with a minimum supplementary cost, thanks to the use of only simple passive elements. The second valve system 30, the check valves V1 and V2, and the calibrated orifices 1 to 4 are not supplied with electric current. The invention allows avoiding the use of a second valve system actively controlled by electric current and associated with an additional spool.

Additional features can be provided, i.e. the passive elements, very well known for an injector designer and for a manufacturer company, so the proposed design is compatible with quality and life time expectation of a diesel injector for both passenger car and heavy duty applications.

According to some embodiments of the invention, the second valve system 30 is thus controlled between its first and second positions by the fuel pressure in a first relief circuit fluidically connected to the control chamber 12 and controlled by the first valve system 20, downstream of a flow restrictor 1 located in said relief circuit when considering the flow of fluid out of the control chamber. More particularly, in some embodiments, in addition to being connected at one end to the control chamber 12 of the injector, said relief circuit may be connected by its other end to the high pressure fuel source 300 when the first valve pressure is in its first position, but to a fuel tank 20 (i.e. at a low pressure) when the first valve system is in its second position.

To that effect, the second valve system may have a control port 22.3 which is connected to the said relief circuit by a control line for controlling opening and closing of the second valve system. The control line may be connected to the relief circuit between a flow restrictor 1 and the first valve system, for example downstream of a flow restrictor in the direction of flow of fuel from the control chamber to the fuel tank 200.

Such control line may have a unidirectional flow restrictor. Alternately, the control line may be divided, at least along part of its length, into an opening control line and a closing control line. The opening and closing control lines may have different flow resistance. The opening control line may have a flow resistor, while the closing control line may have a check valve prohibiting flow from the control port of the second valve system through the closing control line. Both of the opening and closing control lines may be connected to the relief circuit between a flow restrictor 1 and the first valve system.

In some embodiments, the relief circuit comprises a joint line F in common with a fuel feed circuit by which the control chamber may be connected to the high pressure fuel source when the first valve system in its first position. In such a case, the control line of the second valve system may be connected to said joint line of the first relief circuit. In case of a control line divided into an opening control line and a closing control line, both of the opening and closing control lines may be connected to the joint line of the first relief circuit between, preferably between a flow restrictor 1 and the first valve system.

FIG. 8 shows an example of a physical implementation of the fuel injection system.

The fuel injection system 100 comprises a generally cylindrical body 14 mounted on a frame or capnut 13. A generally annular space 15 lies between the frame 13 and the body 14, inside of the frame 13. The space 15 communicates with the fuel tank 200. The first valve system 20 is disposed inside an upper portion of the body 14. The first directional control valve 22 includes an upper plate or armature 21 able to move in a chamber 23 inside the body 14. The armature 21 is able to be attracted by the electromagnetic field of the spool 24. The spring 26 is mounted around a shaft 25 extending the plate 21. The first directional control valve 22 includes a control part 28 lying in a second chamber 27 having a lower portion and an upper portion of smaller dimensions. The upper portion is connected to the passive control line J.

In the first position of the first directional control valve 22, the control part 28 is pushed downwards by the spring 26 so the control part 28 allows a fluid communication between the lower and the upper parts of the second chamber 27. In the second position of the first directional control valve 22, the plate 21 is attracted upwards by the spool 24, so the control part 28 comes up against a wall of the second chamber 27, closing the fluid communication between the lower and the upper parts of the second chamber 27.

The lines A, C, D, E and H are formed by orifices drilled in the body 14. These orifices open in the lower part of the second chamber 27. The check-valves V1 and V2 are thrilled by cavities having a truncated cone shaped wall and a ball able to come into abutment with the wall.

The fuel lines D and E open in a third chamber 31. The second directional control valve 32 is disposed in the third chamber 31 and includes a through hole having ends forming the ports 32.1 and 32.2. The first port 32.1 is able to communicate with the second line B, which opens into the control chamber 12. The second port 32.2 is able to open in the second tank line I, which opens in the space 15. The spring 36 is disposed around a lower part of the second directional control valve 32, in order to move the second directional control valve 32 between its first and second positions. The control chamber 12 communicates with a lower end of the fuel lines A, B and C.

In the shown embodiment, the first 20 and second 30 valve systems are thus integrated in a common body part, namely the body 14. However, at least one or both of said valve systems could be partly or fully exterior to the body 14.

The injector 10 includes a needle 11 disposed in a fourth chamber 33 located inside the body 14 and having nozzles 34 for fuel delivering. The needle 11 has an annular part 17 supporting a spring 16 pushing the needle 11 in a lower position in order to close the nozzles 34. The high pressure line K is formed by an orifice opening in the fourth chamber 33.

FIGS. 9 and 11 to 13 show injection systems 101, 102, 103 and 104 according to alternative embodiments of the invention. The elements of the fuel injection systems 101, 102, 103 and 104 bear the same numerical references as the fuel injection system 100. The following paragraphs only describe the elements and/or features of the alternative embodiments which are different from the fuel injection system 100.

Figure 9:
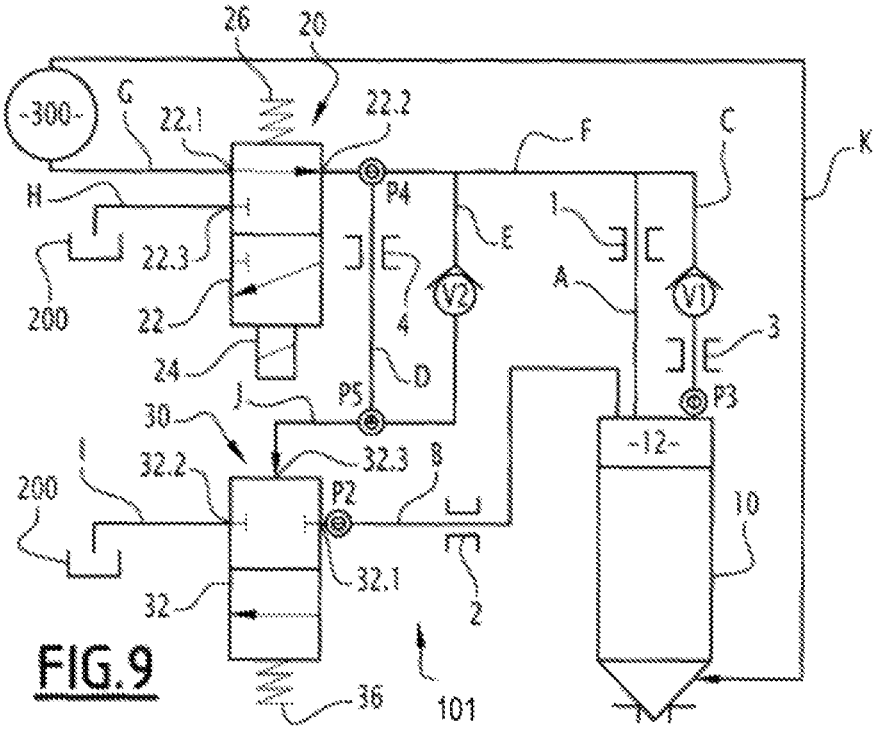
FIGS. 9 to 13 are schematic representation of five alternative embodiments of the injection system according to the invention.

The fuel injection system 101 of FIG. 9 has a first relief line A which connects the joint line F to the control chamber 12 of the injector 10. The second relief line B connects the first port 32.1 of the second directional control valve 32 to the control chamber 12. Thus, contrarily to the fuel injection system 100, the second relief line B of the second injection system 101 is not connected to the first relief line A at the connecting point P1 and the lines A and B opening in the control chamber 12 are separated.

Figure 10:
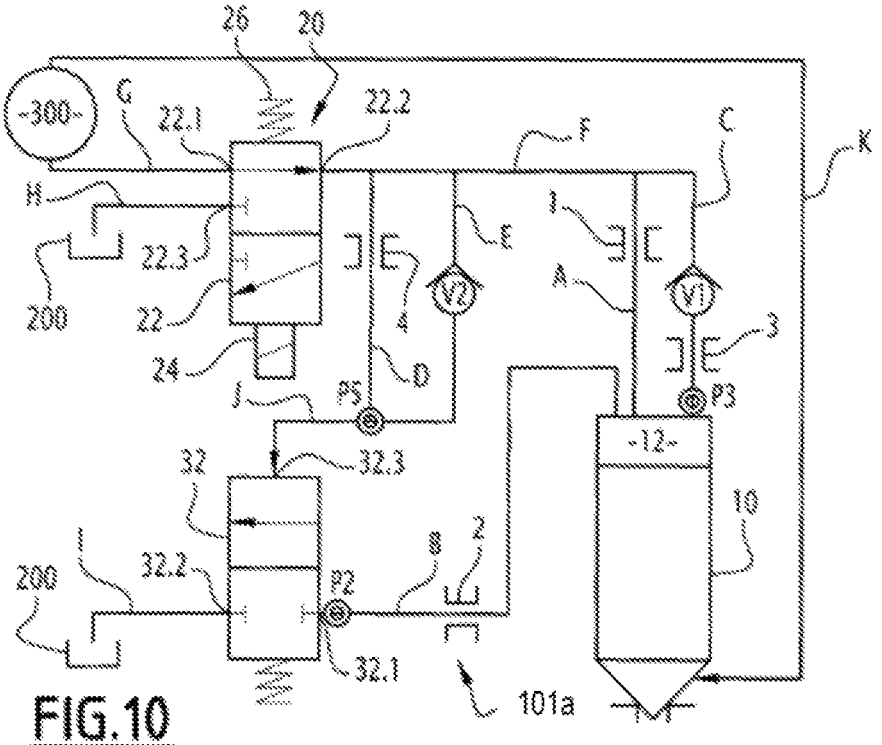

The fuel injection system 101*a* of FIG. 10 shows a variation on the system 101 of FIG. 9. Valve 32 in FIG. 9 is a "normally open" valve, meaning that ports 32.1 and 32.2 communicate with each other as long as the pressure in line J is below a certain pressure, while valve 32 in FIG. 10 is a "normally closed" valve, meaning that ports 32.1 and 32.2 communicate with each other when the pressure in line J exceeds a certain pressure.

Figure 11:
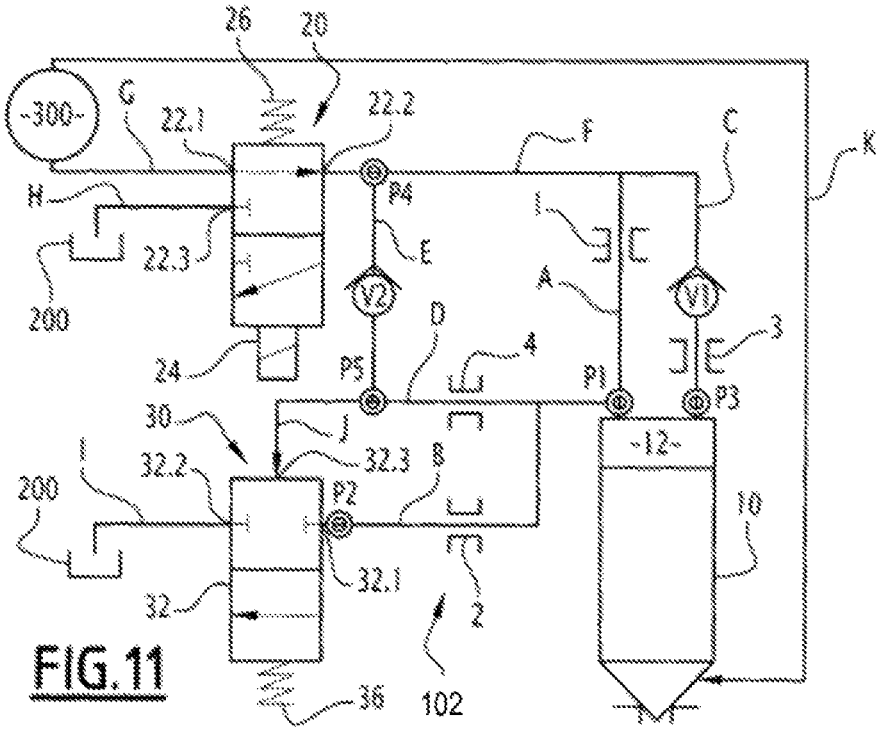

The fuel injection system 102 of FIG. 11 has a closing control line D connecting the passive control line J and the opening control line E to the first relief line A at the first connecting point P1. The fourth orifice 4 is located along the closing control line D between the connecting points P1 and P5.

Figure 12:
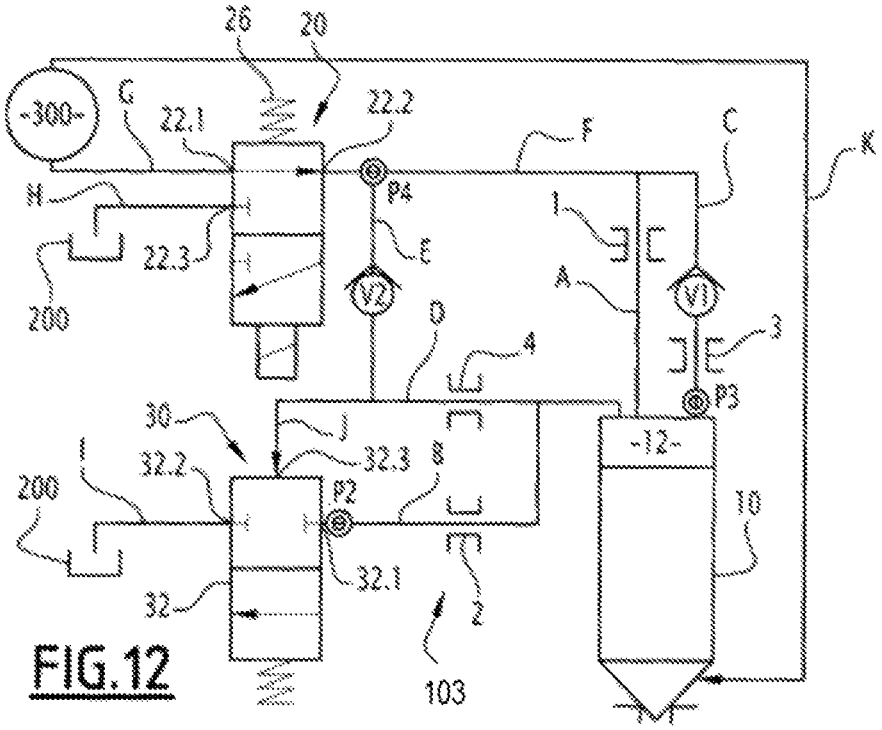

The fuel injection system 103 of FIG. 12 differs from the fuel injection system 102 by the closing control line D which is directly connected to the control chamber 12 instead of being connected to the first relief line A.

Figure 13:
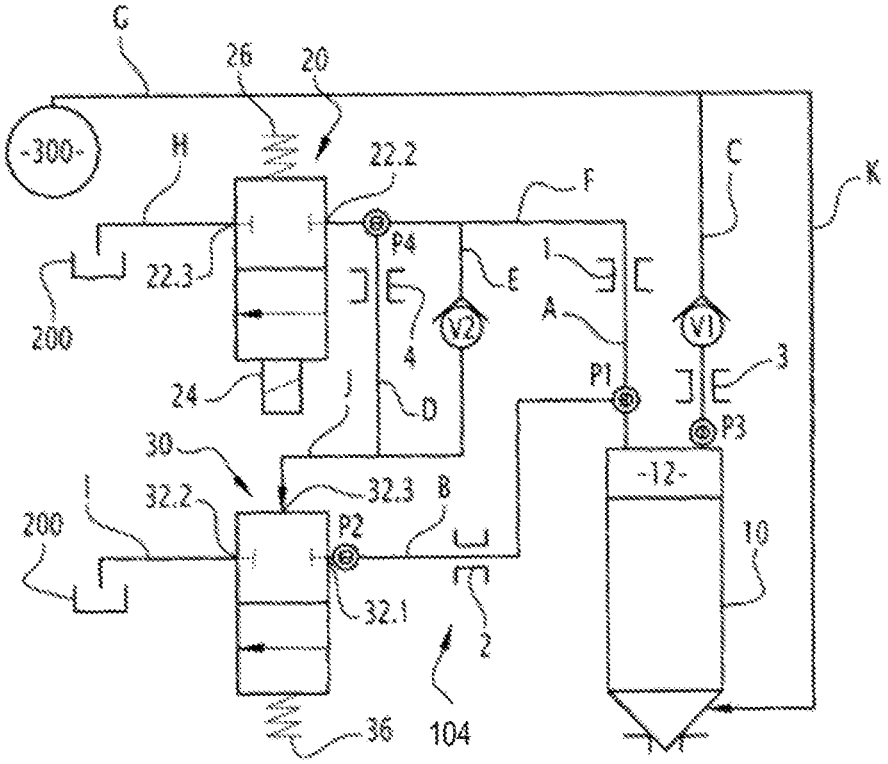

The fuel injection system 104 of FIG. 13 has a first directional control valve 22 having two ports 22.2 and 22.3. The port 22.3 is connected to the fuel tank 200 via the first tank line H and the port 22.3 is connected to the fourth connecting point P4. The high pressure source 300 is connected to the pressure feed line C via the upstream feed line G. The high pressure line K is connected to the lines C and G.

The embodiment of FIG. 13 may be combined with the variants of FIGS. 9 to 12. In the embodiment of FIG. 13, the leakage from high pressure line K to fuel tank 300 is constant during injection.

The invention also encompasses other designs for the control of the pressure in the pressure chamber 12, insofar as the injection system 100 to 105 includes the dual spill flow principle. Thus, the invention applies regardless of the type of the first valve system 20.

In the described embodiments, the flow resistance in a given line or circuit may be set by a calibrated orifice. However, such calibrated orifice may be replaced by any other kind of flow limiter, or may be even dispensed with if the design of the corresponding fluid line or fluid circuit, for example by the size of the fluid conduits or by the flow resistance induced by other components of the line or circuit, creates the desired flow resistance.

In the show embodiment, when the second valve system shifts to its second position allowing relief of pressure from the control chamber, the first valve system remains in its second position so that the pressurized fuel in the control chamber may be reliefs in parallel through the first and the second relief circuits. However, in a non represented variant, the first valve system may be set back to its first position upon the second valve system being set to its second position. In such a case, during the second stage S2, the fuel would evacuate from the control chamber only through the second relief circuit. To obtain a greater speed of increase of the injection rate, the flow resistance in the second relief circuit should then preferably be lower in the second relief circuit than in the first relief circuit.

It is to be understood that the present invention is not limited to the embodiments described above and illustrated in the drawings. Rather, the skilled person will recognize that many changes and modifications may be made within the scope of the appended claims.

The invention claimed is:

1. A fuel injection system of an internal combustion engine, comprising:

an injector having a first hydraulic control chamber with a first pressure controlling the delivery of fuel through the injector;

an actively controlled first valve system controlling pressure relief from the first control chamber, the first valve system being movable between a first position in which the first valve system closes the injector by deterring the first pressure from being relieved from the first control chamber through the first relief circuit, and a second position in which the first valve system opens the injector by allowing the first pressure to be relieved from the first control chamber through a first relief circuit;

a second relief circuit allowing the first pressure to be relieved from the first control chamber;

a needle, wherein the first pressure in the first control chamber controls the position of the needle and the delivery of fuel through a nozzle;

wherein the second relief circuit comprises a second valve system controlled by a second pressure in a second control chamber independently of the position of the needle, the second valve system having a control port passively controlled by the first pressure and movable between a first position in which the second valve system deters the pressure from being relieved from the first control chamber through the second relief circuit and a second position in which the second valve system allows the pressure to be relieved from the first control chamber through the second relief circuit.

2. Fuel injection system according to claim 1, wherein the first valve system includes a first directional control valve having a first port designed to be connected to a high pressure fuel source.

3. Fuel injection system according to claim 1, wherein the first relief circuit includes a first relief line having a first flow resistance for controlling a flow rate of the fuel relieved from the first control chamber.

4. Fuel injection system according to claim 3, wherein during a first injection phase in which the first pressure is relieved from the first control chamber through the first relief circuit and in which the second valve system deters the first pressure from being relieved from the first control chamber through the second relief circuit, a first speed of increase of an injection rate is determined by the first flow resistance.

5. Fuel injection system according to claim 1, wherein the second relief circuit includes a second relief line having a second flow resistance for controlling a flow rate of the fuel relieved from the first control chamber.

6. Fuel injection system according to claim 1, wherein in a second injection phase in which pressure is relieved from the first control chamber through the second relief circuit, a second speed of increase of the injection rate is determined.

7. Fuel injection system according to claim 4, wherein in a second injection phase in which pressure is relieved from the first control chamber through the second relief circuit, a second speed of increase of the injection rate is determined, and wherein the second speed of increase is higher than the first speed of increase.

8. Fuel injection system according to claim 4 wherein in a second injection phase in which pressure is relieved from the first control chamber through the second relief circuit, a second speed of increase of the injection rate is determined, wherein the control port of the second valve system is connected to an opening control line having a flow resistance, for adjusting a timing between the first injection phase and the second injection phase, and a closing control line having a smaller flow resistance than the opening control line and equipped with a check valve preventing flow of fuel from the control port of the second valve system.

9. Fuel injection system according to claim 1, wherein the first valve system includes a first directional control valve electromagnetically controlled by an electronic control unit.

10. Fuel injection system according to claim 1, wherein the first valve system includes a mechanical return device for returning the first valve system to the first position.

11. Fuel injection system according to claim 1, wherein the second valve system includes mechanical return means for returning the second valve system to the first position.

12. Fuel injection system according to claim 1, wherein the injection system includes a third flow resistance for adjusting the closing speed of the injector.

13. Fuel injection system according to claim 1, wherein the injection system includes a pressure feed line for feeding the first control chamber with pressurized fuel, the pressure feed line being equipped with a first check valve preventing flow of fuel from the first control chamber, and a first relief line in parallel with the pressure feed line and having a first flow resistance, for relieving fuel from the first control chamber though the first valve system.

14. Fuel injection system according to claim 13, wherein the injection system includes a third flow resistance for adjusting a closing speed of the injector, and wherein the third flow resistance for adjusting the closing speed of the injector is located in the pressure feed line.

15. Fuel injection system according to claim 1, wherein when the pressure in the first control chamber is above a pressure threshold, the needle closes the nozzle and wherein, when the pressure in the first control chamber is below the pressure threshold, the needle opens the nozzle.

16. Fuel injection system according to claim 1, wherein the injector system includes a mechanical return device applying a closing force to the needle for maintaining the needle in a closed position.

17. Fuel injection system according to claim 1, wherein the first valve system and the second valve system are integrated in a common body part and wherein the needle is disposed in a pressure chamber having the nozzle for fuel delivery, the pressure chamber being located inside the body part.

18. Fuel injection system according to claim 1, wherein the needle is movable in a pressure chamber by means of a difference in pressure between the first control chamber and the pressure chamber.

19. Fuel injection system according to claim 1, wherein, in the first position of the first valve system the first pressure is delivered to the first control chamber through the first valve system.

20. An automotive vehicle comprising the fuel injection system according to claim 1.

* * * * *